US009299225B2

(12) United States Patent
Suttie et al.

(10) Patent No.: US 9,299,225 B2
(45) Date of Patent: Mar. 29, 2016

(54) VALUE MEDIA DISPENSER RECOGNITION SYSTEMS

(71) Applicant: NCR Corporation, Duluth, GA (US)

(72) Inventors: Robert Suttie, Scotland (GB); Gordon Burke, Scotland (GB); Alan James Finnie, Scotland (GB); Grant William Smith, Scotland (GB)

(73) Assignee: NCR Corporation, Duluth, GA (US)

( * ) Notice: Subject to any disclaimer, the term of this patent is extended or adjusted under 35 U.S.C. 154(b) by 0 days.

(21) Appl. No.: 14/312,076

(22) Filed: Jun. 23, 2014

(65) Prior Publication Data

US 2015/0371506 A1 Dec. 24, 2015

(51) Int. Cl.
*G07D 7/00* (2006.01)
*G07F 19/00* (2006.01)

(52) U.S. Cl.
CPC ..... *G07F 19/201* (2013.01); *G07F 19/203* (2013.01)

(58) Field of Classification Search
CPC ..... G07D 7/00; G07D 7/20; G07D 7/205
USPC ..... 382/135; 235/379
See application file for complete search history.

(56) References Cited

U.S. PATENT DOCUMENTS

| | | | | |
|---|---|---|---|---|
| 2010/0202680 | A1* | 8/2010 | Hamasaki et al. | 382/137 |
| 2011/0129139 | A1* | 6/2011 | Numata et al. | 382/137 |
| 2011/0206265 | A1* | 8/2011 | Numata et al. | 382/135 |
| 2014/0083814 | A1* | 3/2014 | Nomura et al. | 194/206 |

* cited by examiner

*Primary Examiner* — Christle I Marshall
(74) *Attorney, Agent, or Firm* — Schwegman, Lundberg, Woessner

(57) ABSTRACT

Value media is driven along a media path through a value media dispenser. While traversing the path, the media is imaged and a denomination and serial number for the media extracted from media image. The media image, denomination, and serial number are recorded for tracking and monitoring of the value media being dispensed from the value media dispenser.

19 Claims, 7 Drawing Sheets

VALUE MEDIA DISPENSER RECOGNITION SYSTEMS

BACKGROUND

Currency dispensers generally have minimal functionality, especially when embedded in an Automated Teller Machine (ATM). However, increasingly data recording and tracking requirements are required to assure accuracy of properly dispensing currency denominations from the dispenser.

Moreover, any error rate at all is an unacceptable situation to both the customers receiving currency from the ATM and to the enterprises that service and stock the ATM with the currency. Because, when currency loading errors occur someone is short funds, either the customer or the enterprise that stocks the ATM.

Fraud is also an issue because a service engineer may knowingly or unknowingly stock an ATM with counterfeit currency, such that whoever is eventually caught with the counterfeit currency may incur legal troubles and that individual may find it very difficult to trace back to where the counterfeit currency came from. Even assuming the counterfeit currency can be tracked back to an ATM, proving the ATM dispensed it may be even more problematic with lack of proper record keeping.

Essentially, currency dispensed from an ATM is not adequately tracked, recorded, or monitored. In response, some governments (particularly China with others to follow) are proposing laws and regulations to provide tracking and record keeping of the currency dispensed from ATMs.

The challenge is that the dispensers embedded in the ATM are largely mechanical with minimal processing capabilities.

SUMMARY

In various embodiments, a value media dispenser and methods for tracking, monitoring, and recording value media dispensed from a value media dispenser are provided.

According to an embodiment, a value media dispenser is provided. The value media dispenser includes at least one scanner and an image controller configured and adapted to: execute on the dispenser, obtain at least one image of media being dispensed from the dispenser, and extract from the at least one image one or more of: a denomination for the media and a serial number for the media.

DETAILED DESCRIPTION

Figure 1A:
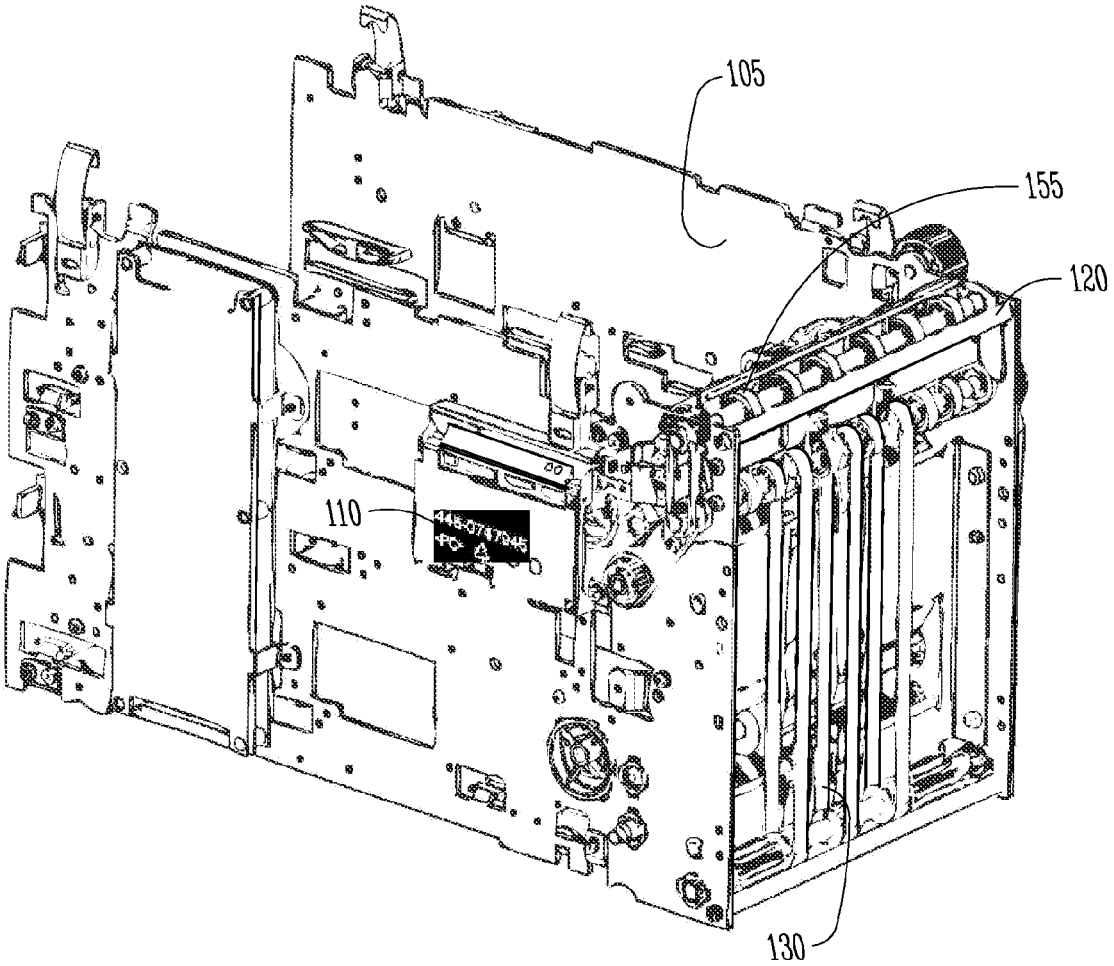
FIG. 1A is a diagram depicting a one-sided view of a pick module for a value media dispenser, according to an example embodiment.

FIG. 1A is a diagram depicting a one-sided view of a pick module for a value media dispenser, according to an example embodiment. It is to be noted that the value media dispenser is shown from two sides, with only those components relevant to understanding what has been added and modified to a conventional dispenser for purposes of providing novel tracking, monitoring, and recording of value media denominations and value media serial numbers imprinted on the value media denominations as the value media is dispensed from the value media dispenser.

As used herein, the phrase "value media" refers to media of value, such as currency, coupons, value tickets, and the like.

For purposes of the discussions that follow with respect to the FIGS. 1A-1D, "value media" is referred to as currency and the "value media dispenser" is referred to as "dispenser."

It is also noted that also some dimensions and measurements are illustrated with the discussions of the FIGS. 1A-1D, these dimensions and measurements may be altered without departing from the novel teachings presented herein for tracking, monitoring, and recording currency denominations and currency serial numbers dispensed from the novel dispenser.

The dispenser's pick assembly 105 is depicted in the FIG. 1A with the control panel removed so that various components are visible. The pick assembly 105 includes an integrated image processor 110, a tie bar, a SNR sub assembly 155, and a plurality of belts 130 (other components exists as well but for purposes of understanding the novel changes made to a conventional dispenser these components are discussed with reference to the FIG. 1A).

The image processor 110 is electrically coupled to image sensors or scanners that reside on both sides of the media feed path (discussed below with reference to the FIGS. 1B-1D and residing within the SNR sub assembly 155). The image processor receives images captured by the image scanners (an image of the front of the currency as it passes through the media feed path and before it exits the dispenser and a second image of the back of the currency as it passes through the media feed path and before it exits the dispenser).

The image processor 110 is also electrically coupled to the host machine that the dispenser is integrated into, such as an ATM (could also be any Self-Service Terminal (SST)). For purposes of the embodiments presented with the FIGS. 1A-1D, the host machine that has the dispenser integrated therein is an ATM.

The image processor 110 may also extract from the front and back images the currency denomination (for example, $1, $5, $20, $50, $100, etc.) and extract serial numbers imprinted on the currency. The image processor 110 then communicates the images and/or the extracted denominations and serial numbers to a tracking, monitoring, and recording application on the ATM.

This information (full images (front and back for the currency), currency denomination, and serial numbers) is used by the tracking, monitoring, and recording application to note (such as in a database, table, log, file, ledger, etc.) what was dispensed from the dispenser. This information can be useful should an issue of fraud arise and can also be used to demonstrate governmental compliance.

In an embodiment, the image processor 110 may also capture and send a variety of other information with the images, currency denominations, and serial numbers, such as time of day, ATM identifier, calendar day, transaction identifier, agent identifier that stocked the ATM with the currency, and customer identifier associated with the dispensed cash and the transaction.

In an embodiment, the image processor 110 may include a known list of bad serial numbers known to be counterfeit, such that the image processor 110 can cause the dispenser to move the currency being dispensed to a reject bin and not permit the counterfeit currency to be dispensed to the customer. So, when an extracted serial number matches a serial number in the list, the currency is rerouted to a reject bin within the dispenser.

In another embodiment, the image processor 110 may keep track of serial numbers that it dispensed since being stocked with currency, such that should a same serial number appear a second time from the same stocked currency, the image processor 110 can send such currency to the reject bin within the dispenser.

The dispenser also includes a tie bar 120 that separates two sets of rollers. This provides added structure.

The SNR sub assembly 155 (FIGS. 1B-1C) is inserted above and separated from the conventional drive belt arrangement of a conventional dispenser. The SNR sub assembly 155 includes the front and back scanners/sensors (discussed below) and is interfaced to the image processor 110. The drive belts 130 are shorter than conventional dispensers, which extend all the way to the top edge of pick assembly 105. The upper section of the transport (represented by the shorter belts) is replaced with the SNR sub module 155. The SNR sub module 155 ensures positive and consistent drive of the media past the scanners 150 and 160 to achieve image quality.

Figure 1B:
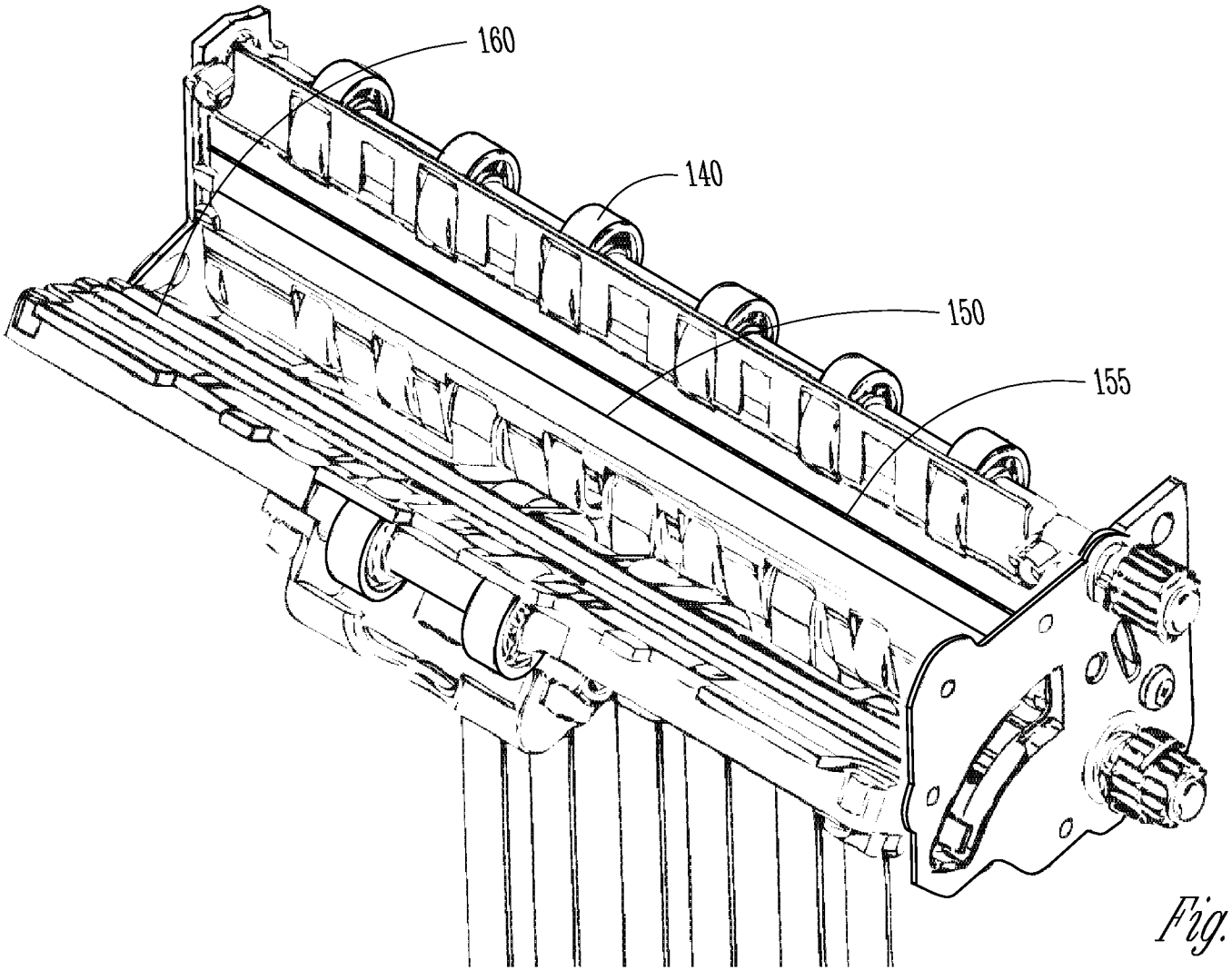
FIG. 1B is a diagram depicting an open media path of a Serial Number Reader sub assembly for the value media dispenser of the FIG. 1, according to an example embodiment.

FIG. 1B is a diagram depicting an open media path of a SNR sub assembly 155 for the value media dispenser of the FIG. 1, according to an example embodiment.

The FIG. 1B is the SNR sub assembly 155 that is inserted behind the tie bar 120 and above the drive belts 130 of the two-side view of the pick assembly 105 shown in the FIG. 1A.

When the currency is being imaged along the media path, the SNR sub assembly 155 is closed (FIG. 1C) for purposes of obtaining a front and back image of the currency. The image of the SNR sub assembly 155 is opened (FIG. 1B) to illustrate the placement and location of the dual opposing scanners 150 and 160. Moreover, the SNR sub assembly 155 may be opened for cleaning and or to clear currency jams that may occur (via a release handle or latch). When the SNR sub assembly 155 is closed (FIG. 1C) the currency is imaged on both sides as it passes through the SNR sub assembly 155 and its two opposing scanners 150 and then the currency is free to move along the media path or in some cases a reject path. The SNR sub assembly 155 is by default closed (FIG. 1C) for operation and held into place by two opposing magnetics that keep the scanners 150 and 160 in proximity to one another for imaging the front and back of the currency as it moves along the media path (transport path) toward dispensing from the dispenser. There is a gap of 1.8 mm maintained between the two scanners while in the closed and operation position (FIGS. 1C and 1D (showing gap as item 170).

The bottom half of the SNR sub assembly 155 includes rollers engaged by the drive belts 130 and those rollers engage other rollers 140 (top rollers 140) to drive the currency through the SNR sub assembly 155 along the media path on its way to exiting the dispenser. As the currency passes through the pluggable module it is forced through two opposing scanners or image sensors 150 and 160, while the media path is closed (FIGS. 1C and 1D). The scanners 150 and 160 are activated and images are acquired for the front and back of the currency as it passes through the SNR sub assembly 155 (closed state for the SNR sub assembly 155 shown in the FIGS. 1C and 1D). The images (front and back) are communicated to the image processor 110. The image processor 110 collects metadata, serial numbers, and a denomination for the currency and sends that to the ATM application for recordation. As mentioned above, the image processor 110 may also alter the media path, in some embodiments, to send the currency to a reject bin within the dispenser.

Figure 1C:
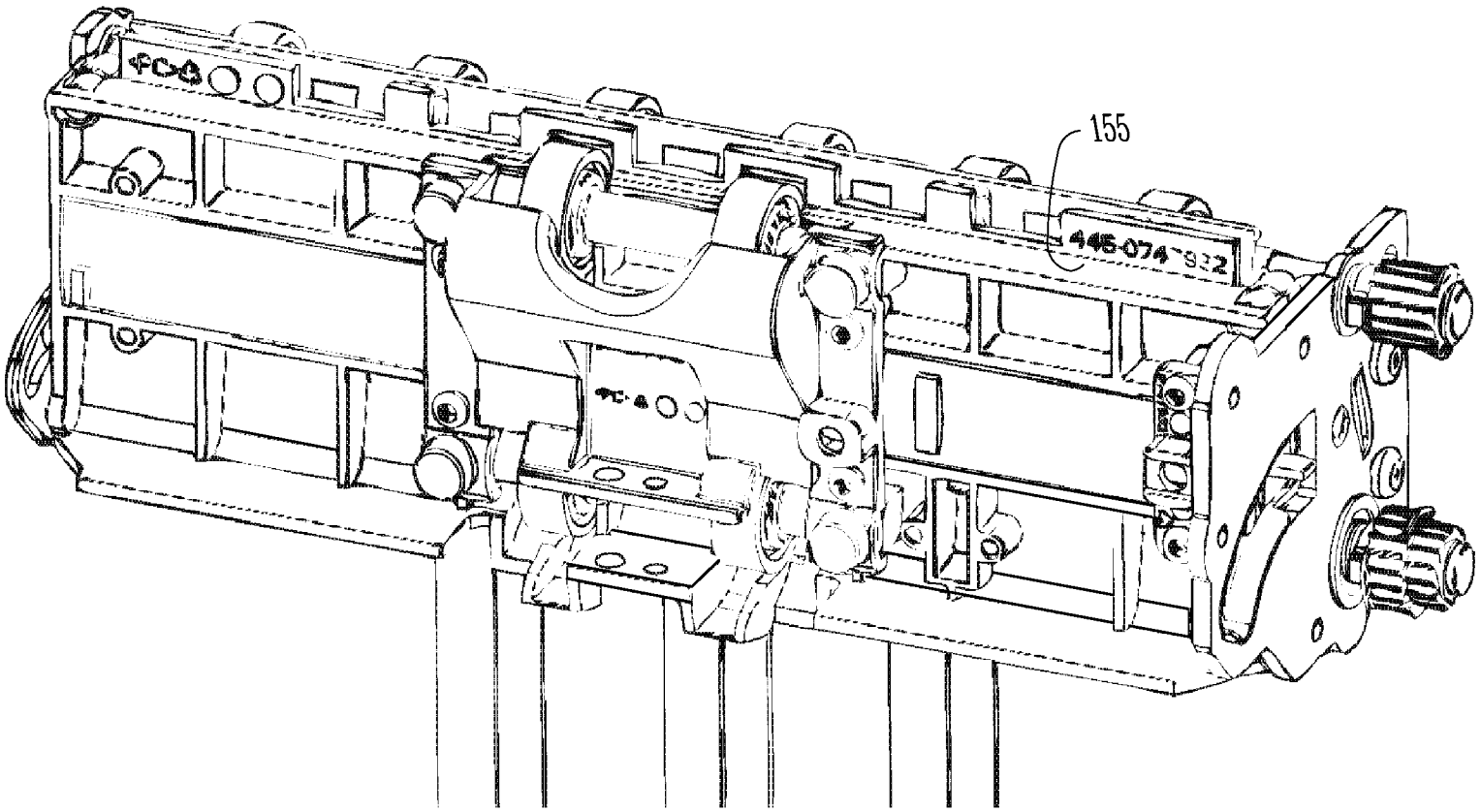
FIG. 1C is a diagram depicting a closed media path of a Serial Number Reader sub assembly for the value media dispenser of the FIG. 1, according to an example embodiment.

FIG. 1C is a diagram depicting a closed media path of a SNR sub assembly 155 for the value media dispenser of the FIG. 1, according to an example embodiment, according to an example embodiment. This arrangement is how the SNR sub assembly 155 is configured during operation of the scanners 150 and 160 (when currency is between the scanners 150 and 160 along the media path) to capture front and back images of the currency, once the images are obtained, the currency continues along the media path to exit the dispenser to a customer or to be rerouted to a reject bin (as discussed above).

Figure 1D:
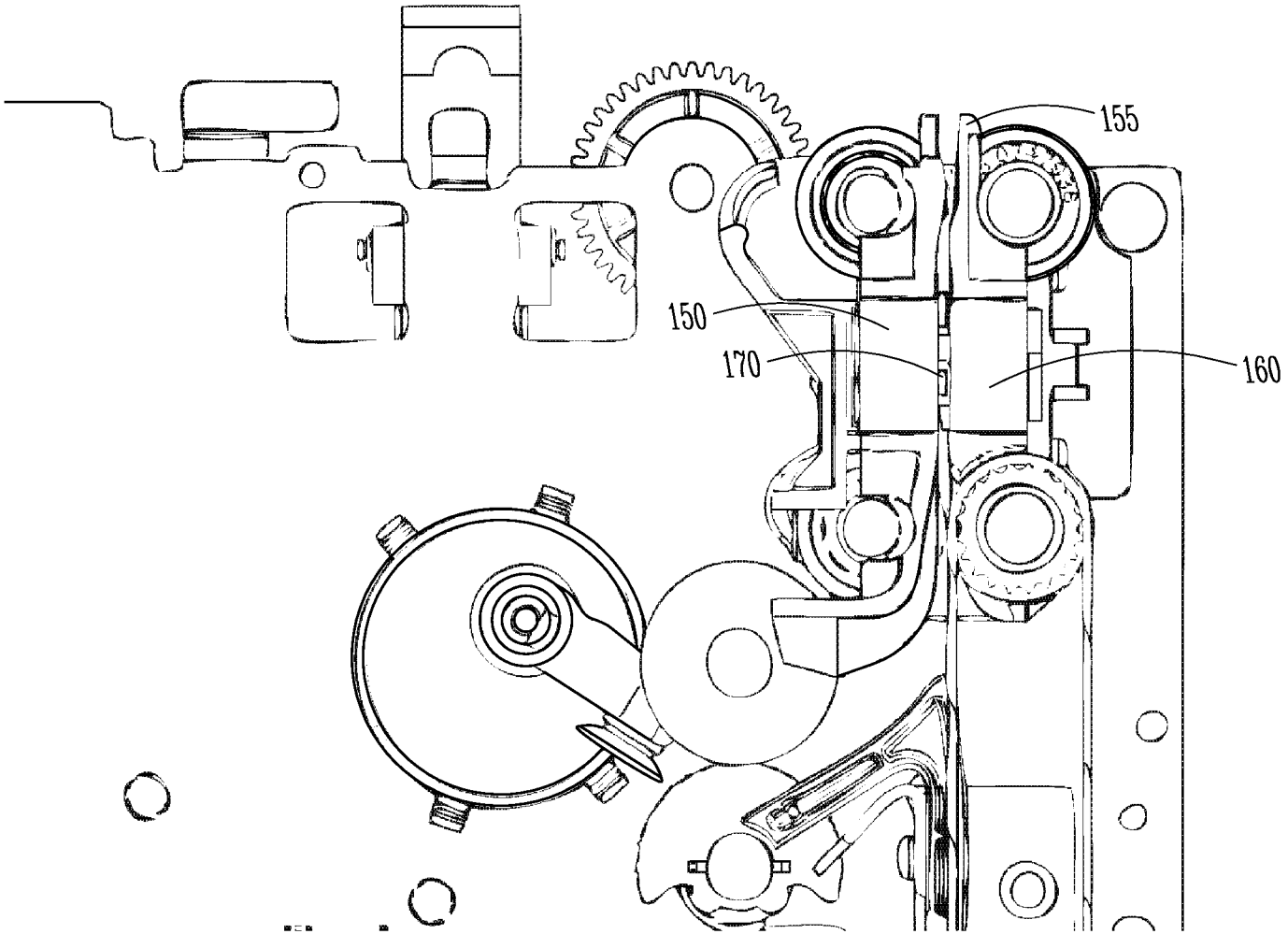
FIG. 1D is a diagram depicting a cross section of the media path showing drive rollers, scanners, and media guides for the value media dispenser of the FIG. 1, according to an example embodiment.

FIG. 1D is a diagram depicting a cross section of the media path showing drive rollers, scanners, and media guides for the value media dispenser of the FIG. 1, according to an example embodiment.

The FIG. 1D shows the orientation of the SNR sub assembly 155 during operation of the scanners 150 and 160 from a side view. The image sensors/scanners 150 and 160 are situated on both and opposing sides of the currency as it passes through the media path. A gap 170 is depicted to show the media path between the two image sensors 150 and 160. In an embodiment, this gap 170 is about 1.8 mm and each scanner 150 and 160 has a focal length ranging from 0 to 0.9 mm. Once the images are obtained, the currency to exits the dispenser along an exit media path or for the currency to is rerouted to a reject bin within the dispenser.

In an embodiment, a magnetic latch on the SNR sub assembly 155 is used to retain the scanners in their operating position but the device may also be opened by pulling the magnetic latch apart for cleaning and jam clearance. Again, an open position (FIG. 1B) would be for cleaning and clearing jams and the closed position (FIGS. 1C and 1D) would be normal operation of the dispenser. Moreover, the open and closed position of the SNR sub assembly 155 is monitored by an optical sensor.

In an embodiment, the opposing sides that house the scanners 150 and 160 are opaque and include carbon for anti-static properties.

In an embodiment, the front and back images of the currency can also be processed by the image processor to determine whether the currency is damaged and needs taken out of circulation. This can be done by extracting image attributes, which are then compared against one or more thresholds for the obtained attributes. So, the dispenser is not only capable of tracking, monitoring, and recording currency denominations and serial numbers but can also be used as a quality control mechanism for the currency being dispensed from the dispenser.

In an embodiment, the novel dispenser is integrated into a SST.

In an embodiment, the novel dispenser is integrated into a self-service checkout station.

In an embodiment, the novel dispenser is integrated into a kiosk.

One now appreciates how a conventional dispenser can be modified to achieve a new and novel dispenser that provides improved fraud detection, quality enforcement, tracking, monitoring, and recording for currency being dispensed by a dispenser integrated into an ATM.

These and other embodiments are now discussed with reference to the FIGS. 2-4.

Figure 2:
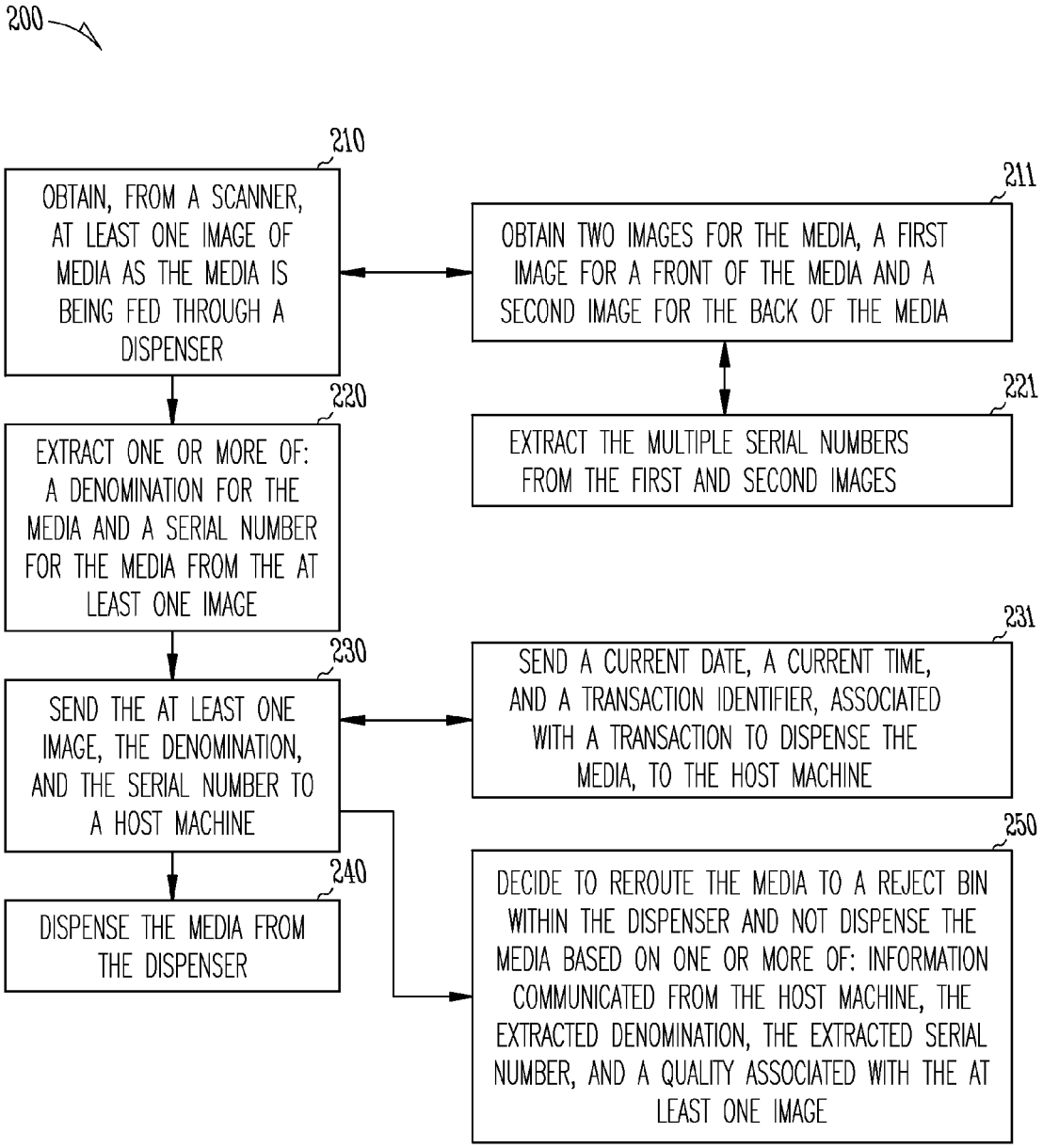
FIG. 2 is a diagram of a method for monitoring, tracking, and recording value media when the value media is dispensed from a value media dispenser, according to an example embodiment.

FIG. 2 is a diagram of a method 200 for monitoring, tracking, and recording value media when the value media is dispensed from a value media dispenser, according to an example embodiment. The method 200 is implemented as one or more software modules as executable instructions that are programmed within memory or non-transitory computer readable storage media and executed by a processing device. The software module(s) are referred to herein as an "image controller." The image controller may or may not have access to a network, and any such network may be wired, wireless, or a combination of wired and wireless.

In an embodiment, the image controller is processed by the image processor 110 and integrated into a dispenser.

In an embodiment, the dispenser is integrated into an ATM.

In an embodiment, the dispenser is integrated into a SST.

In an embodiment, the dispenser is integrated into a self-service checkout station.

In an embodiment, the dispenser is integrated into a kiosk.

In an embodiment, the value media is currency.

In an embodiment, the value media is a coupon.

In an embodiment, the value media is a value ticket.

At 210, the image controller obtains at least one image of media as the media is being fed through a dispenser. The media is value media, such as currency, coupons, value tickets and the like. The media is automatically fed through the dispenser along a media path for dispensing or in some cases for being housed in a reject bin within the dispenser. The at least one image is obtained from one or more scanners integrated into the dispenser along the media path.

According to an embodiment, at 211, the image controller obtains two images for the media. The first image is for a front side of the media and the second image is for the back side of the media.

At 220, the image controller extracts one or more of: a denomination for the media and a serial number for the media from the least one image obtained from the one or more scanners.

In an embodiment of 211 and 220, at 212, the image controller extracts multiple serial numbers from the first and second images. That is, serial numbers may often be repeated on each side of the media. So, capturing the multiple serial numbers provides an added check against fraud in a situation where a serial number on the front of the media does not match a serial number on the back of the media. There may also be other letters or numbers indicating the mint and batch associated with the creation of the media that can be captured and extracted as well.

At 230, the image controller sends the at least one image, the denomination, and the serial number to a host machine to which the dispenser is integrated into.

In an embodiment, at 231, the image controller sends a current date, a current time, and a transaction identifier, associated with a transaction to dispense the media, to the host machine. Other metadata may be sent as well, such as what was discussed above.

According to an embodiment, at 240, the image controller dispenses the media from the dispenser once the image or images are processed and the information (discussed above) was extracted and forwarded to the host machine.

In another case, at 250, the image controller decides to reroute the media to a reject bin within the dispenser and not dispense the media. This can be done based on a variety of conditions. For example, the media may be rejected based on one or more of: information dynamically communicated from the host machine, the extracted denomination (when it exceeds the transaction amount), the extracted serial number, and a quality assessment associated with the image or images (front and back).

Figure 3:
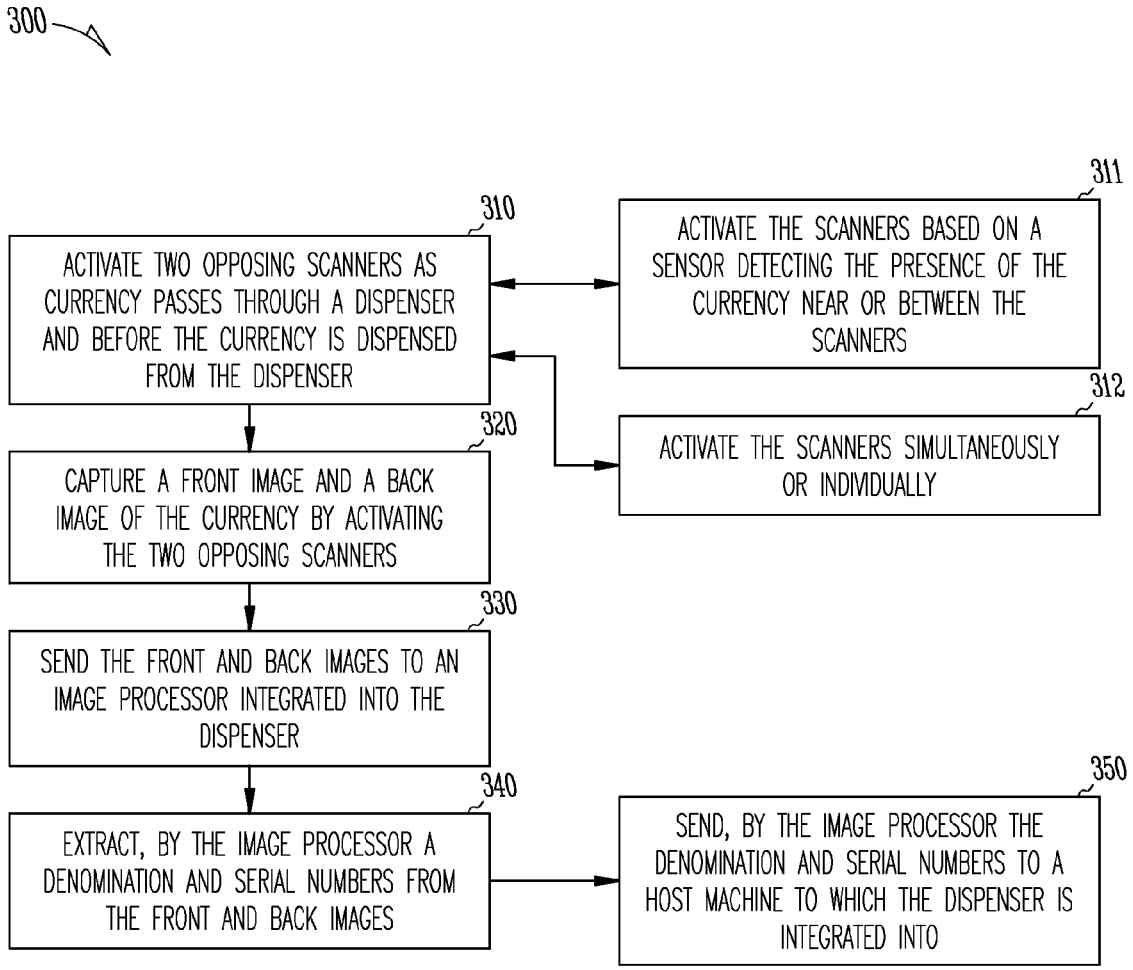
FIG. 3 is a diagram of another method for monitoring, tracking, and recording value media when the value media is dispensed from a value media dispenser, according to an example embodiment.

FIG. 3 is a diagram of another method 300 for monitoring, tracking, and recording value media when the value media is dispensed from a value media dispenser, according to an example embodiment. The method 300 is implemented as one or more software modules as executable instructions that are programmed within memory or non-transitory computer readable storage media and executed by a processing device. The software module(s) are referred to herein as a "media validator." The media validator may or may not have access to a network, and any such network may be wired, wireless, or a combination of wired and wireless.

The media validator presents another processing perspective (and perhaps enhanced processing perspective) to that which was presented above with respect to the image controller of the FIG. 2.

In an embodiment, the media validator is processed by the image processor 110 and integrated into a dispenser.

In an embodiment, the dispenser is integrated into an ATM.

In an embodiment, the dispenser is integrated into a SST.

In an embodiment, the dispenser is integrated into a self-service checkout station.

In an embodiment, the dispenser is integrated into a kiosk.

In an embodiment, the value media is currency.

In an embodiment, the value media is a coupon.

In an embodiment, the value media is a value ticket.

At 310, the media validator activates two opposing scanners as currency passes through a dispenser and before the currency is able to be dispensed from the dispenser.

In an embodiment, at 311, the media validator activates the scanners based on a sensor detecting the presence of the currency near or between the scanners.

In an embodiment, at 312, the media validator activates the scanners simultaneously or individually.

At 320, the media validator captures a front image and a back image of the currency by activating the two opposing scanners. One scanner capturing the front image and the remaining opposing scanner capturing the back image.

At 330, the media validator sends the front and back images to an image processor integrated into the dispenser, such as was discussed above with reference to the FIGS. 1A-1D and 2.

According to an embodiment, at 340, the media validator extracts, via the image processor, a denomination and serial numbers for from the front and back images.

In an embodiment of 340 and at 350, the media validator sends, via the image processor, the denomination and serial numbers to a host machine to which the dispenser is integrated into.

Figure 4:
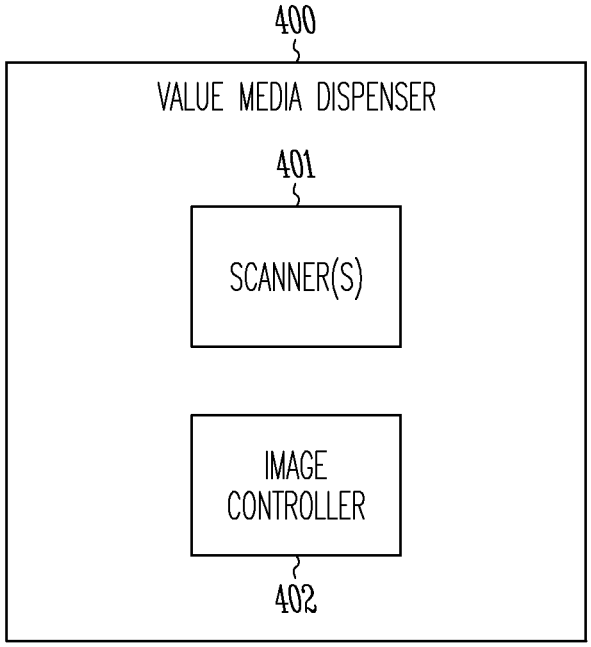
FIG. 4 is a value media dispenser, according to an example embodiment.

FIG. 4 is a value media dispenser 400, according to an example embodiment. The value media dispenser 400 dispenses value media includes a variety of mechanical and electrical components, some of which were discussed above with reference to the FIGS. 1A-1D.

In an embodiment, the value media dispensed by the value media dispenser 400 is currency.

In an embodiment, the value media dispensed by the value media dispenser 400 is a coupon.

In an embodiment, the value media dispensed by the value media dispenser 400 is a value ticket.

In an embodiment, the value media dispenser 400 is the dispenser discussed above with reference to the FIGS. 1A-1D.

In an embodiment, the value media dispenser 400 is integrated into an ATM.

In an embodiment, the value media dispenser 400 is integrated into a SST.

In an embodiment, the value media dispenser 400 is integrated into a self-service checkout station.

In an embodiment, the value media dispenser 400 is integrated into a kiosk.

The value media dispenser 400 includes at least one scanner 401 and an image controller 402.

The at least one scanner 401 is situated within the value media dispenser 400 along a media feed path. In an embodiment, the value media dispenser 400 includes two scanners 401, each scanner 401 situated on an opposite side of the value media as it passed along the media path between the scanners 401.

The at least one scanner 401 is integrated into the value media dispenser 400.

In an embodiment, the at least one scanner 401 is the one or both of the scanners 150 and 160 of the FIGS. 1A-1D.

The image controller 402 is implemented as one or more software modules that are programmed within memory and/or non-transitory computer-readable storage media of a processor integrated into the value media dispenser 400.

According to an embodiment, the image controller 402 is the image controller of the FIG. 2.

In an embodiment, the image controller 402 is the media validator of the FIG. 3.

In an embodiment, the image controller 402 is programmed within memory or non-transitory computer-readable storage media of the image processor 110 of the FIG. 1A.

The image controller 402 is adapted and configured to: integrated within the value media dispenser 400, obtain at least one image of media being dispensed from the value media dispenser 400, and extract from the at least one image one or more of: a denomination for the media and a serial number for the media.

In an embodiment, the image controller 402 is further adapted and configured to send the image, the denomination, and the serial number to a host machine that the value media dispenser 400 is integrated into.

In an embodiment of the latter embodiment, the image controller 402 is also adapted and configured to send a date, a time, and a transaction identifier for a transaction, associated with dispensing the media, to the host machine.

In an embodiment, the image controller 402 is further adapted and configured to prevent the media from being dispensed from the value media dispenser 400.

In an embodiment of the latter embodiment, the image controller 402 is also adapted and configured to alter a media path from the media to deposit the media in a rejected bin within the value media dispenser 400.

In an embodiment, the image controller 402 is adapted and configured to obtain a front image and a back image of the media using two scanners 401.

In an embodiment, the image controller 402 is adapted and configured to extract the denomination from the media and multiple serial numbers from a front image and back image of the media using two scanners 401.

It should be appreciated that where software is described in a particular form (such as a component or module) this is merely to aid understanding and is not intended to limit how software that implements those functions may be architected or structured. For example, modules are illustrated as separate modules, but may be implemented as homogenous code, as individual components, some, but not all of these modules may be combined, or the functions may be implemented in software structured in any other convenient manner.

Furthermore, although the software modules are illustrated as executing on one piece of hardware, the software may be distributed over multiple processors or in any other convenient manner.

The above description is illustrative, and not restrictive. Many other embodiments will be apparent to those of skill in the art upon reviewing the above description. The scope of embodiments should therefore be determined with reference to the appended claims, along with the full scope of equivalents to which such claims are entitled.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Description of the Embodiments, with each claim standing on its own as a separate exemplary embodiment.

The invention claimed is:

1. A dispenser, comprising: at least one scanner within the dispenser along a media path of the dispenser; and an image controller configured and adapted to: i) obtain at least one image of media being dispensed from the dispenser; and ii) extract from the at least one image one or more of: a denomination for the media and a serial number for the media; wherein the dispenser is within a Self-Service Terminal.

2. The dispenser of claim 1, wherein the image controller is further configured and adapted to: iii) send the image, the denomination, and the serial number to a host machine that the dispenser is integrated into.

3. The dispenser of claim 2, wherein the image controller, in iii) is further configured and adapted to send a date, a time, and a transaction identifier for a transaction associated with dispensing the media to the host machine.

4. The dispenser of claim 1, wherein the image controller is further configured and adapted to: iii) prevent the media from being dispensed.

5. The dispenser of claim 4, wherein the image controller, in iii), is further adapted and configured to alter a media path for the media to deposit the media in a rejected bin within the dispenser.

6. The dispenser of claim 1, wherein the image controller, in i), is further adapted and configured to obtain a front image and a back image of the media.

7. The dispenser of claim 1, wherein the image controller, in ii), is further adapted and configured to extract the denomination for the media and multiple serial numbers for the media from a front image and a back image of the media.

8. The dispenser of claim 1, wherein media is one of: currency, a coupon, and a value ticket.

9. A method, comprising: obtaining, from a scanner that is within a dispenser along a media path of the dispenser, at least one image of media as the media is being fed through the dispenser, and the dispenser within a Self-Service Terminal; extracting one or more of: a denomination for the media and a serial number for the media from the at least one image; and sending the at least one image, the denomination, and the serial number to a host machine.

10. The method of claim 9, wherein obtaining further includes obtaining two images for the media, a first image for a front of the media and a second image for the back of the media.

11. The method of claim 10, wherein extracting further includes extracting the multiple serial numbers from the first and second images.

12. The method of claim 9, wherein sending further includes sending a current date, a current time, and a transaction identifier, associated with a transaction to dispense the media, to the host machine.

13. The method of claim 9 further comprising, dispensing the media from the dispenser.

14. The method of claim 9 further comprising, deciding to reroute the media to a reject bin within the dispenser and not dispense the media based on one or more of: information communicated from the host machine, the extracted denomination, the extracted serial number, and a quality associated with the at least one image.

15. A method, comprising: activating two opposing scanners as currency passes through a dispenser and before the currency is dispensed from the dispenser, each scanner within the dispenser along a currency path of the dispenser and the dispenser within a Self-Service Terminal (SST); capturing a front image and a back image of the currency by activating the two opposing scanners; and sending the front and back images to an image processor integrated into the dispenser.

16. The method of claim 15, wherein activating further includes activating the scanners based on a sensor detecting the presence of the currency near or between the scanners.

17. The method of claim 15, wherein activating further includes activating the scanners simultaneously or individually.

18. The method of claim 15, further comprising extracting, by the image processor a denomination and serial numbers from the front and back images.

19. The method of claim 18 further comprising, sending, by the image processor the denomination and serial numbers to the SST to which the dispenser is integrated into.

* * * * *